US009328960B2

(12) United States Patent
Di Lisa et al.

(10) Patent No.: US 9,328,960 B2
(45) Date of Patent: May 3, 2016

(54) METHOD AND DEVICE FOR PRODUCING ANODES

(75) Inventors: Domenico Di Lisa, Duisburg (DE); Frank Heinke, Weimar (DE); Peter Krieg, Weimar (DE); Detlef Maiwald, Moers (DE); Hans-Peter Mnikoleiski, Duisburg (DE); Wolfgang Uhrig, Laubach (DE)

(73) Assignee: INNOVATHERM PROF. DR. LEISENBERG GMBH+CO. KG, Butzbach (DE)

( * ) Notice: Subject to any disclaimer, the term of this patent is extended or adjusted under 35 U.S.C. 154(b) by 818 days.

(21) Appl. No.: 13/510,248

(22) PCT Filed: Nov. 15, 2010

(86) PCT No.: PCT/EP2010/067512

§ 371 (c)(1),
(2), (4) Date: Aug. 3, 2012

(87) PCT Pub. No.: WO2011/061159

PCT Pub. Date: May 26, 2011

(65) Prior Publication Data

US 2012/0295208 A1 Nov. 22, 2012

(30) Foreign Application Priority Data

Nov. 20, 2009 (DE) ..... 10 2009 046 937

(51) Int. Cl.
*F27B 13/06* (2006.01)
*F27B 13/02* (2006.01)

(52) U.S. Cl.
CPC ..... *F27B 13/02* (2013.01)

(58) Field of Classification Search
CPC ..... C10J 2300/0956
USPC ..... 432/128, 192, 144, 145, 149, 249, 152
See application file for complete search history.

(56) References Cited

U.S. PATENT DOCUMENTS 1,330,164 A * 2/1920 Broadwell ..... 432/169
4,253,823 A * 3/1981 Holdner ..... 432/18

(Continued)

FOREIGN PATENT DOCUMENTS

DE 20 10 372 A1 9/1971
DE 2008206 A1 9/1971

(Continued)

OTHER PUBLICATIONS

The English translation of the International Preliminary Report on Patentability as mailed on Jun. 21, 2012 for International Application No. PCT/EP2010/067512.

(Continued)

*Primary Examiner* — Gregory A Wilson
(74) *Attorney, Agent, or Firm* — Quarles & Brady LLP

(57) ABSTRACT

An air feeding device for producing anodes in an annular kiln includes at least one kiln unit having a heating zone, a firing zone, and a cooling zone, each having a plurality of kiln chambers which are interconnected by heating channels, are formed as heat exchangers and are used to receive anodes. Primary air is introduced into the cooling zone by a primary air feeding device for the passage of air through the kiln unit and, once it has passed through the firing zone, being discharged from the heating zone as flue gas by means of an exhaust device. Secondary air is fed into the heating zone upstream of the exhaust device by a secondary air feeding device.

10 Claims, 1 Drawing Sheet

(56) References Cited

U.S. PATENT DOCUMENTS

| | | | | |
|---|---|---|---|---|
| 4,382,778 | A * | 5/1983 | Peacey et al. | 432/18 |
| 4,504,219 | A * | 3/1985 | Thomas | 432/4 |
| 4,687,439 | A * | 8/1987 | Olivarez et al. | 432/192 |
| 4,859,175 | A * | 8/1989 | Dreyer et al. | 432/4 |
| 5,759,027 | A * | 6/1998 | Werge-Olsen et al. | 432/192 |
| 8,419,422 | B2 * | 4/2013 | Mahieu et al. | 432/192 |
| 8,651,856 | B2 * | 2/2014 | Leisenberg | 432/192 |
| 2013/0337391 | A1 * | 12/2013 | McGee et al. | 432/29 |

FOREIGN PATENT DOCUMENTS

| | | | |
|---|---|---|---|
| EP | 0 541 165 | A2 | 5/1993 |
| WO | 2004027332 | A1 | 4/2004 |
| WO | PCT/FR2010/000413 | A1 | 11/2010 |

OTHER PUBLICATIONS

The International Search Report as mailed on Mar. 14, 2011 for International Application No. PCT/EP2010/067512.

* cited by examiner

METHOD AND DEVICE FOR PRODUCING ANODES

CROSS-REFERENCE TO RELATED APPLICATIONS

This application represents the national stage entry of PCT International Application No. PCT/EP2010/067512 filed on Nov. 15, 2010 and claims the benefit of German Patent Application No. DE 10 2009 046 937.0 filed Nov. 20, 2009. The contents of both of these applications are hereby incorporated by reference as if set forth in their entirety herein.

STATEMENT REGARDING FEDERALLY SPONSORED RESEARCH OR DEVELOPMENT

Not applicable.

FIELD OF THE INVENTION

The present invention relates to a method for producing anodes in an annular kiln, comprising at least one kiln unit having a heating zone, a firing zone, and a cooling zone, each having a plurality of kiln chambers interconnected by heating channels, said chambers being formed as heat exchangers and being used to receive anodes, in said method primary air being introduced into the cooling zone by means of an air feeding device for the passage of air through the kiln unit and, once it has passed the firing zone, being discharged from the heating zone in the form of flue gas by means of an exhaust device. The invention further relates to an air feeding device for an annular kiln and to an annular kiln provided with an air feeding device of this type.

The present invention is used in the production of anodes which are required for fused-salt electrolysis for the production of primary aluminium. These anodes are produced in the form of "green anodes" or "raw anodes" from petroleum coke with the addition of pitch as a binding agent in a forming method and are then sintered in an annular kiln after the forming method. This sintering procedure takes place in a heat-treatment process which progresses in a defined manner, in which the anodes pass through three phases: namely a heating phase, a sintering phase and a cooling phase. The raw anodes are heated or pre-heated in the heating zone before being heated in the burning or firing zone, after the heating phase, to sintering temperatures of approximately 1100° C.

BACKGROUND OF THE INVENTION

In practice, it has been found that the progression of the heating of the raw anodes during the heating phase is of key importance for the quality of the final anodes produced by sintering. In particular, it has been found that the heating gradient reached during the heating phase is decisive for the quality of the anodes. In particular, a high heating gradient, in particular a heating gradient >14° K/h, can lead to the formation of cracks in the anode. Since, in the case of high-density anodes, a particularly high tendency for crack formation can be determined and since it has not previously been possible in practice to implement the much lower heating gradients, in particular heating gradients <8° K/h, which are necessary to avoid crack formation, when heating raw anodes of relatively high density compared to the heating of raw anodes of relatively low density, anodes of relatively high density therefore were not previously produced in "open annular kilns" in industrial practice, these kilns being operated in a vacuum environment with no covering of the kiln chamber. Instead, anodes of high density were previously fired substantially exclusively in "covered" firing kilns, which have much lower efficiency however compared to open annular kilns however.

SUMMARY OF THE INVENTION

The object of the present invention therefore is to propose a method and a device which make it possible to produce high-density anodes of high product quality in an annular kiln.

In the method according to an embodiment of the invention, secondary air is fed into the heating zone, upstream of the exhaust device, by means of a secondary air feeding device. Due to the feed of secondary air into the heating zone, it is possible to selectively influence the heating gradient in the heating zone, which otherwise would be dependent, merely by the passage of air in the kiln, on the physics of the kiln vessel, in particular on the nature and geometry of the heating channels of the kiln vessel, and therefore would be practically impossible to influence. In particular, it is possible to reduce the heating gradient, which is desirable for the heating of high-density raw anodes, by feeding secondary air into the heating zone.

As a result of the addition of an additional air volume flow by the secondary air feeding device within the heating zone, this influence on the heating gradient is made possible without having to simultaneously change in the firing zone the air-fuel ratio ideal for sintering.

Alongside the above-mentioned advantage of a reduction of the heating gradient in the heating zone, the oxygen fraction in the flue gas is also increased by the feed of secondary air into the heating zone, and therefore complete combustion of the pitch can be achieved even in the case of high-density anodes, which have a greater fraction of pitch, which would not be possible without the feed of secondary air. This results in a corresponding reduction in the emissions, in particular with regard to CO, paH 16 and benzene. Lower energy consumption of the kiln is thus also enabled.

It has proven to be particularly advantageous if the secondary air feeding device is positioned as a function of at least one process parameter, so that, for example, the secondary air feeding device is positioned at the start of the firing cycle as far away as possible from the firing zone within the heating zone or, at the end of the firing cycle, the secondary air feeding device is arranged in correspondingly close proximity of the firing zone.

It has also proven to be advantageous if secondary air is applied to a plurality of kiln chambers of the heating zone by means of the secondary air feeding device, this application occurring in a selectively simultaneous manner or sequentially.

If the secondary air feed, that is to say for example the volume of secondary air fed per unit of time, is supplied as a function of at least one process parameter, the process parameter can be used to adjust the secondary air feed, for example so as to utilise findings obtained by way of experiment regarding the correlation between specific process parameters and the heating gradient reached in the pre-heating zone.

For example, the secondary air can be fed as a function of the kiln temperature in one or more kiln chambers of the heating zone.

Alternatively or in addition, the secondary air can be fed as a function of the vacuum in the heating zone.

It is also possible to feed the secondary air as a function of the duration of the cycle of the heat treatment of the anodes in the kiln unit, that is to say as a function of the duration of the overall cycle composed of the heating phase, firing phase, and cooling phase.

The secondary air feed can be controlled in a particularly direct manner if the secondary air is fed as a function of a measured value determined for the heating gradient.

In the case of the air feeding device according to an embodiment of the invention, a secondary air feeding device to be arranged in the heating zone is also provided in addition to the primary air feeding device for feeding primary air in the cooling zone.

If the secondary air feeding device of the air feeding device has a positioning device for changeable positioning of the secondary air feeding device in the heating zone, changes can be made to the positioning of the secondary air feeding device as a function of the process parameters.

An air feeding device of which the secondary air feeding device is formed in such a way that it allows secondary air to be applied to a plurality of kiln chambers can increase the efficacy of the influence of the heating gradient yet further still.

If the air feeding device is designed in such a way that at least one measuring device is assigned to the secondary air feeding device, said measuring device generating a measurement of a process parameter as an input variable for a control device of the secondary air feeding device, a self-contained system provided with all necessary devices can be created which, for example, can be easily retrofitted in an existing annular kiln.

In accordance with an embodiment of the invention, the annular kiln is provided with an air feeding device which makes it possible to fire or sinter high-density anodes with the same level of productivity as sintering of low-density anodes.

BRIEF DESCRIPTION OF THE DRAWINGS

A preferred embodiment of the device and an explanation of the practicable method will be presented in greater detail hereinafter with reference to the drawing, in which.

DETAILED DESCRIPTION OF THE EXAMPLE EMBODIMENTS

Figure 1:
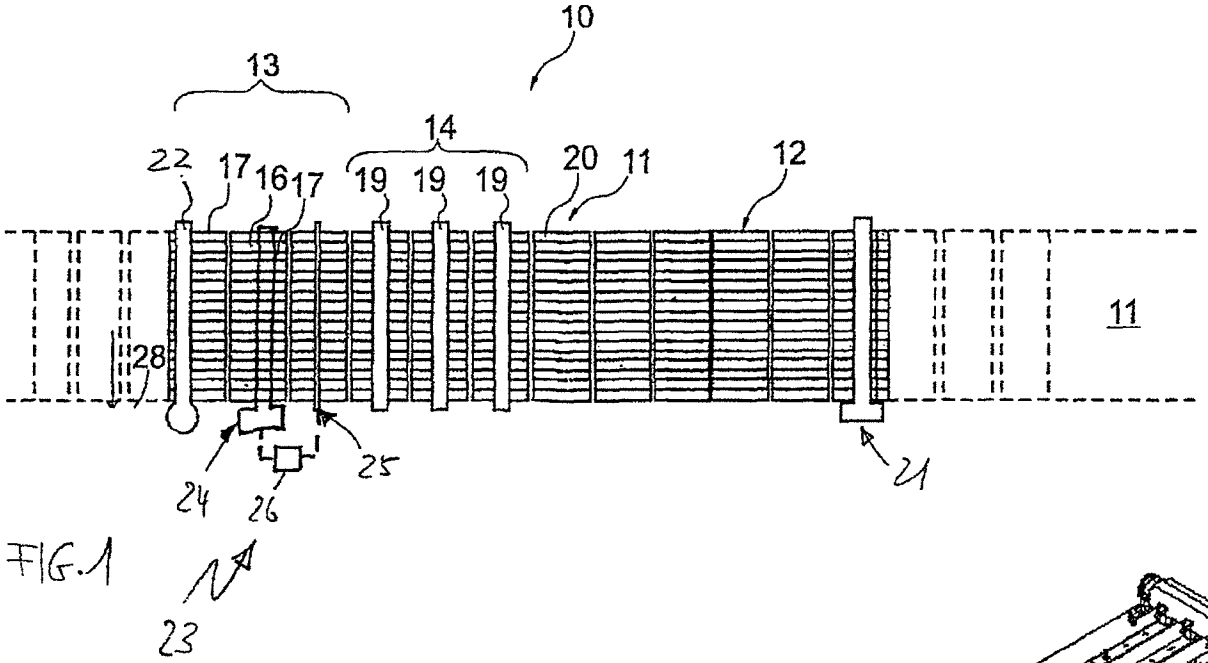
FIG. 1 shows a schematic illustration of an annular kiln.

FIG. 1 shows an annular kiln 10, which generally consists of a plurality of kiln units 11, which are also referred to as "fires". In the present exemplary embodiment, each kiln unit 11 has 12 kiln chambers 12, which are combined in different numbers to form a heating zone 13, a firing zone 14, and a cooling zone 15.

Figure 2:
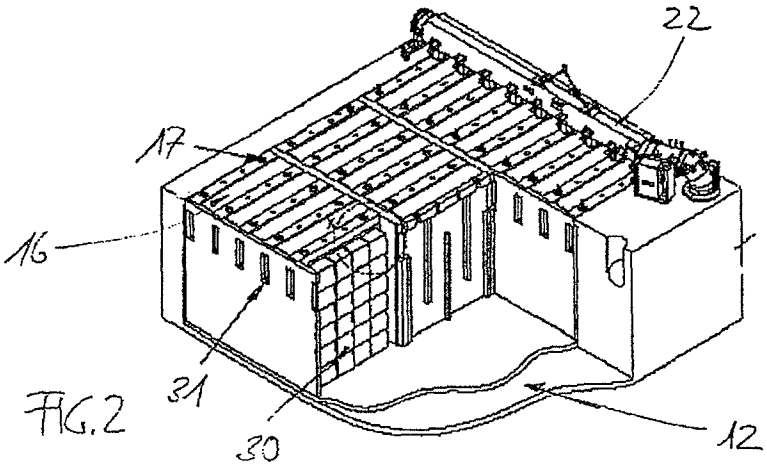
FIG. 2 shows a partial isometric illustration of the annular kiln illustrated in FIG. 1.

As shown in FIG. 2, the kiln chambers 12 have cavities 16, which are each defined on either side by heating channels 17 extending in the longitudinal direction of the kiln unit 11 (FIG. 1). The cavities 16 are used to receive anodes 30, which are received in rows in the cavities 16. The heating channels 17 of the kiln chambers 12 are interconnected fluidically in the longitudinal direction of the kiln unit 11 by flow channels 31.

As is shown in particular in FIG. 1, a number of different devices, which can be changed in terms of their position in relation to the kiln chambers 12 in the direction of circulation 18 (as explained hereinafter) and which define the location of the heating zone 13, firing zone 14, and cooling zone 15 as a result of their respective assignment, are located above the kiln chambers 12, said zones being advanced together with the devices in the direction of circulation 18.

In the design illustrated in FIG. 1, the kiln unit 11 is provided in the firing zone 14 with three firing devices 19. The firing devices 19 are each assigned to a kiln chamber 12, the cavities 16 of which are equipped with raw anodes which are heated by means of the temperature applied by the firing devices 19 to approximately 1100° C. and are sintered to produce anodes which can be used for salt-fusion electrolysis. The anodes are not exposed directly to high temperature by the firing devices 19; instead, heat is transferred from the air guided into the heating channels 17 to the anodes arranged in the cavities 16 via heating channel walls 20. The kiln chambers 12 therefore act as heat exchangers.

The cooling zone 15 is located to the right of the firing zone 14 in FIG. 1, in the present case said cooling zone having six kiln chambers 12, in which the raw anodes have been sintered in two previous firing phases, in which the firing devices 19 were located in the corresponding position, under the application of high temperature. In the design illustrated in the drawing, a primary air feeding device 21 is located above an outer kiln chamber 12 of the cooling zone 15 and can be used to apply fresh air and/or ambient air to the heating channels 17.

An exhaust device 22 (see FIG. 2 also) for the flue gases is arranged above the kiln chambers 12 in the heating zone 13 to the left of the firing zone 14, unsintered raw anodes which have not yet been exposed to high temperature by the firing devices 19 being located in said kiln chambers.

During operation of the annular kiln 10, in which high temperatures are applied to the anodes in the firing zone 14, the heat stored in the anodes arranged in the cooling zone 15 and previously exposed to high temperature by the firing devices 19 is simultaneously released. The corresponding waste heat is guided, with a feed of fresh air through the primary air feeding device 21, into the heating zone 13 by means of the exhaust device 22 arranged in the heating zone 13, where it is used to pre-heat the anodes before they are then exposed to the firing devices 19. The function of the primary air feeding device 21 and the exhaust device 22 are adapted to one another by means of suitable regulator and control devices, so that a predefined progression of temperature over time is reached in the heating channels extending between the cavities 16, supplemented by a controlled fuel feed of the firing devices 19.

As can be inferred from the drawing, the annular kiln 10 or the kiln unit 11, illustrated by way of example, has an air feeding device 23, which also comprises a secondary air feeding device 24 arranged in the heating zone 13 in addition to the primary air feeding device 21. In the exemplary embodiment illustrated, the secondary air feeding device 24 is provided with a measuring device 25, with which process parameters, such as temperature and/or vacuum, can be measured in the heating zone 13 and forwarded as input variables to a control device 26 of the secondary air feeding device 24, which controls the air volume flow introduced into the heating zone 13 via the secondary air feeding device 24.

The invention claimed is:

1. A method for producing anodes in an annular kiln, said kiln including at least one kiln unit having a heating zone, a firing zone, a cooling zone, and a plurality of kiln chambers interconnected by heating channels forming heat exchangers used to receive anodes, said method comprising:

introducing primary air into the cooling zone using a primary air feeding device for the passage of air through the kiln unit;

discharging the primary air from the heating zone as flue gas using an exhaust device once the primary air passed through the firing zone;

feeding secondary air into the heating zone upstream of the exhaust device with regard to a direction of the primary air flow, using a secondary air feeding device; and positioning said secondary air feeding device as a function of at least one process parameter.

2. The method according to claim 1, in which secondary air is applied to a plurality of kiln chambers in the heating zone by the secondary air feeding device.

3. The method according to claim 1, in which the secondary air is fed as a function of at least one process parameter.

4. The method according to claim 3, in which the secondary air is fed as a function of a kiln chamber temperature in one or more kiln chambers in the heating zone.

5. The method according to claim 3, in which the secondary air is fed as a function of a vacuum in the heating zone.

6. The method according to claim 3, in which the secondary air is fed as a function of a duration of a cycle of a heat treatment of the anodes.

7. The method according to claim 1, in which the secondary air is fed as a function of a measured value determined of a heating gradient.

8. An air feeding device for an annular kiln for producing anodes, said feeding device comprising:

a primary air feeding device introducing primary air into a cooling zone of a kiln unit; and a secondary air feeding device positioned at a position in a heating zone of the kiln unit and introducing secondary air into the heating zone of the kiln unit, said position of said secondary air feeding device being changeable in said heating zone; and at least one measuring device assigned to said secondary air feeding device and generating a measured value of a process parameter as an input variable for changing said position of said secondary air feeding device in said heating zone.

9. The air feeding device according to claim 8, in which the secondary air feeding device introduces secondary air to a plurality of kiln chambers.

10. An annular kiln for producing anodes, said kiln comprising an air feeding device according to claim 8.

* * * * *